US005697160A

United States Patent [19]

Pritsker

[11] Patent Number: 5,697,160

[45] Date of Patent: Dec. 16, 1997

[54] EATING UTENSIL FOR PASTA

[76] Inventor: Robert Pritsker, 422 Marion Ave., Mill Valley, Calif. 94941

[21] Appl. No.: 662,831

[22] Filed: Jun. 12, 1996

[51] Int. Cl.[6] ..... A47J 43/28

[52] U.S. Cl. ..... 30/326; 30/324; D7/663

[58] Field of Search ..... 30/150, 324, 325, 30/326, 327, 328, 147, 149; D7/653, 662, 663

[56] References Cited

U.S. PATENT DOCUMENTS

| | | | |
|---|---|---|---|
| D. 32,327 | 3/1900 | Coghian | 30/324 |
| D. 67,759 | 7/1925 | Meehan | 30/324 |
| 621,944 | 3/1899 | Ring | 30/326 |
| 724,246 | 3/1903 | Bentley | 30/325 |
| 780,492 | 1/1905 | Boutelle | 30/324 |
| 944,091 | 12/1909 | Harn | 30/324 |
| 2,853,779 | 9/1958 | Lordo | 30/150 |
| 3,138,871 | 6/1964 | Sears | 30/150 |
| 3,939,562 | 2/1976 | Pellerin | 30/149 |

*Primary Examiner*—Hwei-Siu Payer

*Attorney, Agent, or Firm*—Flehr Hohbach Test Albritton & Herbert LLP

[57] ABSTRACT

An eating utensil used in cooperation with a fork to eat elongate type pasta in a manner which prevents splattering of pasta sauce onto the user. The utensil is comprised of a handle which carries a bowl which is formed with an upwardly concave center portion. A rim on the outer periphery of the center portion extends in an oval-shaped configuration, and a shield is mounted on one side of the rim. The shield is comprised of an upright wall having a curvature which conforms with the rim curvature. The height of the wall is effective to constrain the pasta and sauce above the bowl and within the shield as the tines of the fork, while being held and twisted by the user, turn and wrap the pasta into a bundle which can then be lifted away from the utensil for eating.

5 Claims, 1 Drawing Sheet

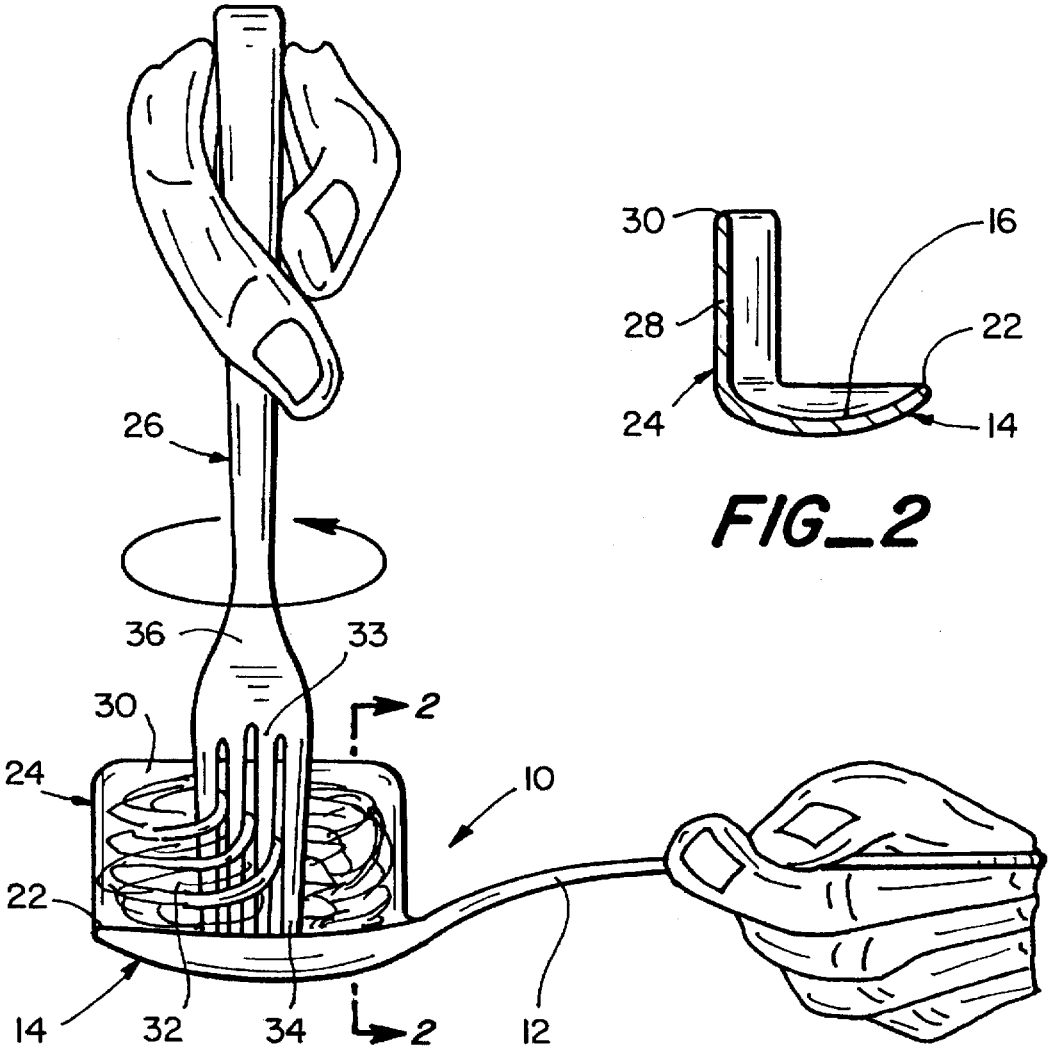
FIG_1
FIG_2
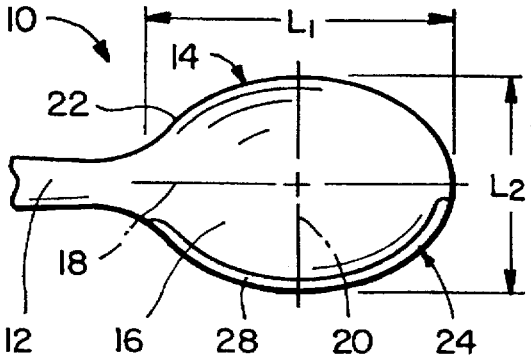
FIG_3
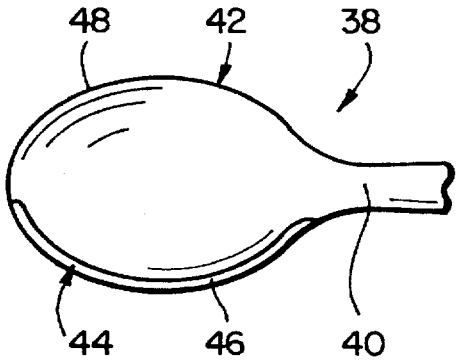
FIG_4

EATING UTENSIL FOR PASTA

BACKGROUND OF THE INVENTION

1. Field of the Invention

This invention relates in general to eating utensils. More particularly, the invention relates to utensils for use in eating pasta in combination with a fork.

2. Description of the Related Art

Elongate pasta such as long-stranded spaghetti, fettucini, linguini and vermicelli is commonly eaten when dining by a person holding a spoon in one hand and a fork in the other. With the spoon in the pasta, the tines of the fork are placed into the spoon bowl and turned so that the pasta strands wrap around the tines into a bundle. The fork is then raised to bring the bundle of strands into the person's mouth for eating. However, the rotary motion of the fork can cause liquid sauce clinging to the strands to be thrown off by centrifugal force. As a result, the sauce can splatter onto the diner's vestments or onto the tablecloth.

Among the expedients commonly used to avoid the problems in eating long-stranded pasta is for a diner to tuck a napkin into his or her shirt at the neckline, or to use a bib. Gentlemen dining on pasta oftentimes tuck their ties into the opening of their shirts where the shirt is joined at the button panel. However, bibs and napkins are not discreet, and oftentimes the diner avoids their use out of self consciousness. If bibs and napkins are either not used or are unavailable, cleaning bills and ruined clothing can result from the splattering of pasta sauce. If they are used then the cleaning/laundry problem is merely shifted to that of the bibs or napkins.

The need has therefore been recognized for an eating utensil which obviates the foregoing and other disadvantages of prior art eating utensils. Despite the various eating utensils in the prior art, there has heretofore not been provided a suitable and attractive solution to these problems.

OBJECTS AND SUMMARY OF THE INVENTION

It is a general object of the present invention to provide a new and improved utensil for eating elongate type pasta.

Another object is to provide an eating utensil of the type described which obviates the objectionable problem of the splattering of pasta sauce when a person uses a spoon and fork to wrap strands of pasta into a bundle for eating.

Another object is to provide an eating utensil which protects the clothes of a diner while twirling long-stranded pasta.

Another object is to provide an eating utensil which supplants the use of a bib or napkin, or the tucking of a diner's tie into a shirt, while eating long-stranded pasta.

The invention in summary provides an eating utensil comprising a handle which carries a bowl that has a concave center portion. A rim on the outer periphery of the center portion is oval shaped, and a shield is carried on one side of the rim. The shield comprises an upright wall which is curved in conformance with the rim curvature. The shield has an upper edge which extends above the rim at a height which is effective to constrain the pasta and sauce above the bowl and within the shield as the tines of a fork are turned to wrap the pasta into a compact bundle which can then be lifted away for eating.

The foregoing and additional objects and features of the invention will appear more fully from the following specification when read in conjunction with the accompanying drawings.

BRIEF DESCRIPTION OF THE DRAWINGS

FIG. 1 is a front elevation view of an eating utensil in accordance with one embodiment of the invention showing its use in wrapping pasta with a fork.

FIG. 2 is a cross sectional view taken along the line 2—2 of FIG. 1.

FIG. 3 is a fragmentary top plan view showing details of the bowl and shield of the utensil of FIG. 1.

FIG. 4 is a fragmentary top plan view similar to FIG. 3 showing another embodiment of the invention.

DESCRIPTION OF THE PREFERRED EMBODIMENTS

In the drawings FIG. 1 illustrates generally at 10 an eating utensil in accordance with one preferred embodiment of the invention. Eating utensil 10 is generally spoon-shaped and is comprised of a handle 12 having an end which carries a bowl 14. The bowl is formed with an upwardly concave center portion 16 having an outer periphery which is oval-shaped. As shown in FIG. 3 the major axis 18 of the center portion has a length $L_1$ while its minor axis 20 has a length $L_2$ which is less than $L_1$. The center portion periphery 16 is bounded by a rim 22 having left and right side portions which extend along opposite sides of the major axis in the oval-shaped curvature. The bowl is imperforate as shown in the figures.

A shield 24 is carried on the right-hand portion of rim 22 in the embodiment of FIG. 1. This enables utensil 10 to be suitable for use where the handle is held by the diner's left hand while the right hand can be used to hold and twist a fork 26. Shield 24 comprises an upright wall 28 having a curvature which conforms with the curvature of the right hand portion of the rim. The shield is formed with an upper edge 30 which extends above the rim at a height which is effective to constrain the pasta and sauce 32 within the bowl and shield when wrapped by the fork tines 33. The tines have distal ends 34 which are joined at their proximal ends with the fork shank 36. When the fork is held upright as shown in FIG. 1 with the tine distal ends 34 juxtaposed within the center portion of the bowl then the height of shield wall 28 substantially extends along the tine proximal ends to be effective to constrain the pasta and sauce and prevent the pasta and sauce from being splattered toward the diner. The shield is imperforate as shown in the figures.

In use for eating long-stranded pasta such as spaghetti, fettucini, linguini and vermicelli, handle 12 of the eating utensil is held in the diner's left hand with the bowl level as shown in FIG. 1. As the bowl is placed into a plate of pasta, the diner's right hand holds fork 26 upright with the tines pointed down into the bowl. The right hand is then used to twist or rotate the fork so that the pasta strands are wrapped in a rotary motion which rolls them up into a bundle. Because shield 24 is positioned between the diner and the tines, any liquid sauce clinging to the strands that may be thrown off by centrifugal force when the fork is twirled is prevented by the shield from leaving the area of the bowl.

Liquid sauce captured by the shield will collect in the bowl. With the use of eating utensil 10, each bundle of pasta that is eaten can be followed by drinking sauce collected in the bowl. That is, with the diner's lips on the top edge of the shield, the bowl can be tilted toward a vertical position to enable the sauce to flow into the diner's mouth.

FIG. 4 illustrates another embodiment providing an eating utensil 38 which is adapted to be held in a diner's right hand while eating the long-stranded pasta. Utensil 38 is comprised of a handle 40 and bowl 42 shaped similar to that described for the embodiment of FIG. 1. A shield 44 comprised of an upright wall 46 is mounted on the left side of the bowl rim 48. The upper edge of the shield wall extends above the rim to a height which is effective to constrain the pasta and sauce in the manner described in connection with the embodiment of FIG. 1.

The use of utensil 38 is similar to that described for the embodiment of FIG. 1 except that handle 40 is held in the diner's right hand while the left hand is used to hold and twist a fork. In this mode of use, shield 44 is positioned between the bundle of pasta and the diner to prevent splattering of pasta sauce on the diner while the fork is twisted.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. An eating utensil for use in cooperation with a fork facilitate a person wrapping and lifting elongate type pasta for eating, the utensil comprising the combination of a handle having first and second ends, an imperforate bowl carried on the second end of the handle, the bowl having an upwardly concave center portion which has a first length along a major axis and a second length, which is less than said first length, along a minor axis which is orthogonal to the major axis, said center portion being bounded about its outer periphery by a rim, said rim having first and second portions which extend in an oval shaped curvature along opposite sides of the major axis, an imperforate shield carried on the first portion of the rim, the shield comprising an upright wall having a shape which curves in a direction about a vertical axis and substantially conforms with the curvature of the first portion of the rim, said shield having an upper edge that extends above the rim at a height which is effective to constrain the pasta and sauce above the bowl and within the shield as the tines of the fork, while being held and twisted by the person, turn and wrap the pasta into a bundle which can then be lifted away from the utensil.

2. An eating utensil as in claim 1 in which the first portion of the rim and the shield are positioned on the side of the utensil which is located, relative to the center portion, toward the person when the handle is held by one hand of the person.

3. An eating utensil as in claim 2 in which the first portion of the rim and the shield are positioned on the right side of the utensil when the handle is held by the person's left hand whereby the person's right hand can be used to hold and twist the fork.

4. An eating utensil as in claim 2 in which the first portion of the rim and the shield are positioned on the left side of the utensil when the handle is held by the person's right hand whereby the person's left hand can be used to hold and twist the fork.

5. An eating utensil as in claim 1 for use in cooperation with a fork comprised of a shank and a plurality of tines and with the tines having proximal ends joined with the shank and distal ends, and in which said height of the upper edge of the shield is sufficient to substantially extend along said proximal ends when the fork is held upright and the distal ends are juxtaposed with the center portion of the bowl.

* * * * *